US008607995B1

(12) United States Patent
Mladinich

(10) Patent No.: US 8,607,995 B1
(45) Date of Patent: Dec. 17, 2013

(54) FOLDING SHELF

(76) Inventor: Julius C Mladinich, Denville, NJ (US)

( * ) Notice: Subject to any disclaimer, the term of this patent is extended or adjusted under 35 U.S.C. 154(b) by 0 days.

(21) Appl. No.: 13/612,017

(22) Filed: Sep. 12, 2012

(51) Int. Cl.
*A47G 29/087* (2006.01)

(52) U.S. Cl.
USPC ..... 211/119.004; 211/90.01; 211/104; 232/19; 248/240

(58) Field of Classification Search
USPC ..... 211/119.004, 88.01–88.03, 211/90.01–90.04, 96, 99, 100, 104, 132.1, 211/149, 150; 108/44, 47; 248/99, 100, 248/235, 240; 224/275, 282; 232/19
See application file for complete search history.

(56) References Cited

U.S. PATENT DOCUMENTS

| | | | | |
|---|---|---|---|---|
| 988,097 | A * | 3/1911 | Heyd | 248/101 |
| 2,988,232 | A | 6/1961 | Koett | |
| 3,797,607 | A | 3/1974 | Gargasz | |
| 3,802,620 | A * | 4/1974 | Ferrara | 232/19 |
| 3,828,994 | A * | 8/1974 | Hollins | 224/275 |
| 4,037,542 | A | 7/1977 | Kropiwka | |
| 4,237,915 | A | 12/1980 | Zabielski et al. | |
| 4,372,243 | A * | 2/1983 | Roope, Jr. | 114/364 |
| 4,761,029 | A * | 8/1988 | Woodcock | 294/148 |
| 4,807,927 | A * | 2/1989 | Livick | 297/184.15 |
| 5,052,648 | A | 10/1991 | Landau | |
| 5,480,058 | A | 1/1996 | Hutchins | |
| 5,794,385 | A * | 8/1998 | Donovan | 52/36.4 |
| 6,224,029 | B1 | 5/2001 | Marble et al. | |
| 6,637,609 | B2 * | 10/2003 | Stevens | 211/118 |
| 7,182,243 | B2 * | 2/2007 | Plappert | 232/19 |
| 2004/0006850 | A1 * | 1/2004 | Wax | 24/10 R |
| 2005/0258117 | A1 * | 11/2005 | Drake | 211/106 |

OTHER PUBLICATIONS

Wikipedia, Cup Holder, at http://en.wikipedia.org/wiki.Cup_Holder, reprinted from the Internet on Jun. 12, 2013.

* cited by examiner

*Primary Examiner* — Korie H Chan
(74) *Attorney, Agent, or Firm* — Benjamin Appelbaum

(57) ABSTRACT

Embodiments of the present invention include a folding shelf intended for attachment to a door having a mail slot. The shelf is pivotably attached below the mail slot by a support and moved from its storage position to its operative position by a chain attached to the door by a fastener. The chain is attached to the shelf near that part of the shelf that is distal from the door. Using embodiments of the present invention, items inserted through the door are retained on the shelf rather than fall to the floor, and the door remains functional when the shelf is in the operative position.

12 Claims, 7 Drawing Sheets

FOLDING SHELF

FIELD OF THE INVENTION

Embodiments of the present invention relate to a folding shelf that is mounted to a support, such as a door that contains a slot for inserting mail or other items through the door, such that, after insertion, the items are retained on the shelf rather than fall to the floor. The shelf can be pivotably mounted to the door, enabling the shelf to be stored when not in use.

BACKGROUND OF THE INVENTION

Mail delivery is a service generally taken for granted by most individuals, with some form of mail receptacle located on a property, residence or place of business. These receptacles range from the standard rural delivery box, to individual mail boxes in a residential complex, hand delivery by mail carrier, or in many instances, delivery through a slot in a door, which is generally the front door. After mail is inserted through the door slot, the mail usually falls to the floor. If the delivery has occurred while an individual has left the premises, the delivered mail may block entrance to the location, and after entry, usually requires the individual to bend over and retrieve the items. These activities are not generally a problem for healthy individuals, individuals who are disabled, or have difficulties with balance or bending, find picking up the mail can be a difficult task.

One approach to address this problem has been positioning a box beneath the mail slot to catch the items delivered. This does not solve the problem, because one still has to bend over to reach the box and remove its contents. Placement of a small table or snack tray beneath the mail slot can prevent mail from falling to the floor, provided that the table is positioned properly, but also requires the table to be moved back and forth when using the door to exit or enter the location.

Embodiments of the present invention comprise a folding shelf that is mounted to a door that contains a slot for inserting mail or other items therethrough, such that the items, after insertion, are retained in the tray. The tray can be moved from a storage position where it may rest against the door to its operative position, beneath the mail slot and extending from the door, in a generally perpendicular manner, and is retained in that position either by means of a support, such as a bracket underneath the tray, or held by a chain or similar means, to move the tray to and from its operative position.

BRIEF SUMMARY OF THE INVENTION

It is an object to the present invention to provide a folding shelf that can be attached to a support to receive items deposited through an opening in the support (for example, a door).

Another object of the present invention is to provide a folding shelf that can be readily moved from a storage position to an operative position.

Another object of the present invention is to provide a shelf that can be attached to a support, yet movable from its operative position, to allow the support, such as a door, to be used for its intended purpose.

An other object of the present invention is to provide a folding shelf that can be utilized by the elderly or disabled.

Yet another object of the present invention to provide a folding shelf from which items can be easily retrieved by the user, such as by minimizing the need for a user to bend.

Embodiments of the present invention comprise include a folding shelf intended for attachment to a door having a mail slot. The shelf is pivotably attached below the mail slot by a support and moved from its storage position to its operative position by a chain attached to the door by a fastener. In an embodiment, the chain is attached to the shelf through one or more openings within the shelf proximate the shelf end distal from the door. Using embodiments of the present invention, in the operative position, the shelf is attached to the door and is positioned underneath the mail slot, where items inserted through the door are retained on the shelf rather than fall to the floor. The door remains functional when the shelf is in the operative position, as well as when the shelf is in a storage position.

DETAILED DESCRIPTION OF THE INVENTION

Figure 1:
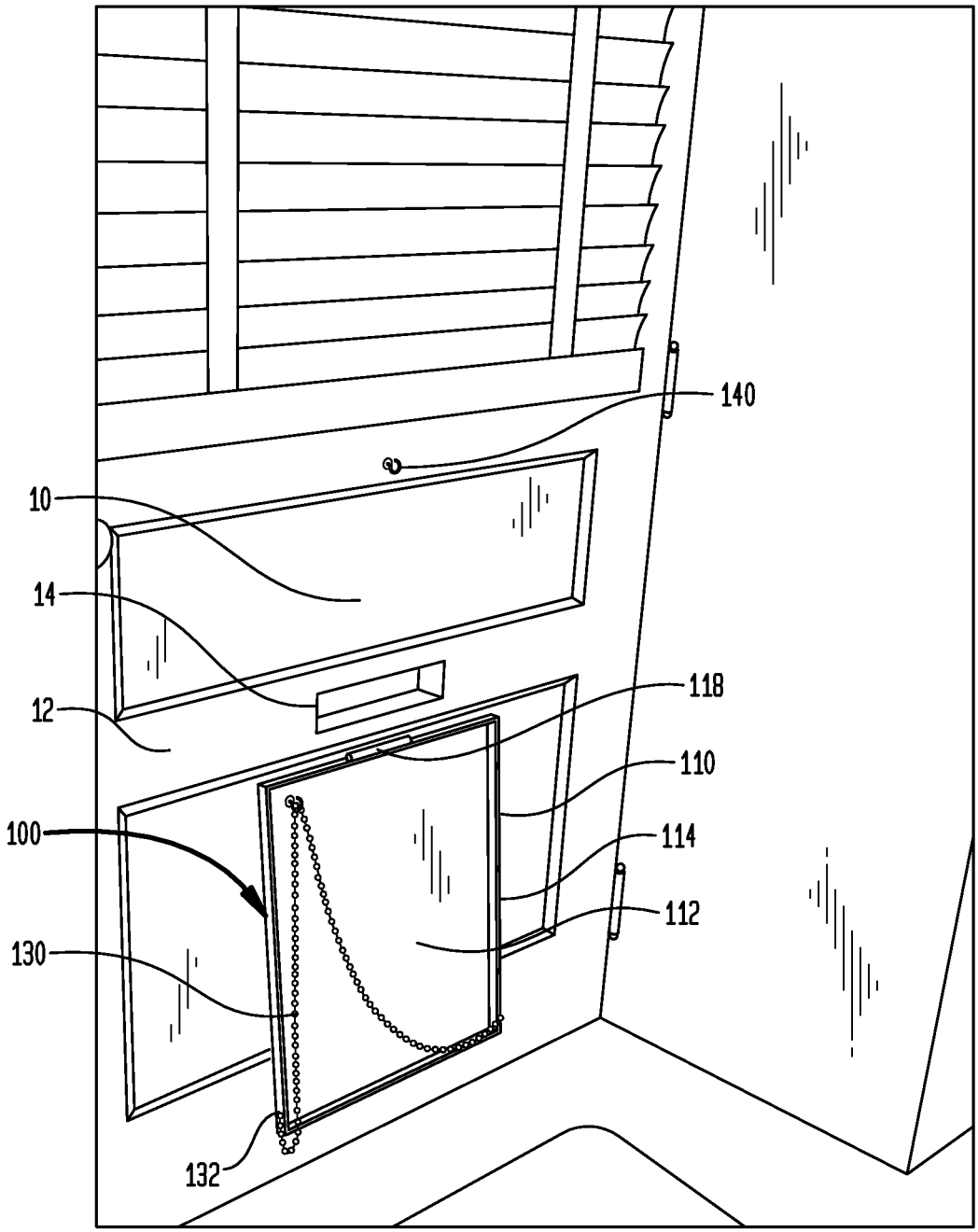
FIG. 1 illustrates an embodiment of the present invention with a chain as the adjustment means.

An embodiment of the present invention is a folding shelf assembly 100 that is mounted on the inside surface 12 of a door 10 proximate a mail slot 14 (or comparable opening) The outside of door 10 may have a covering (not shown) for the slot, the covering serving to prevent weather, air, or other forms of intrusion into the location. The door 10 can be either a metal or wooden door (FIG. 1), and embodiments of the present invention can be configured for attachment to doors made from other materials, such as glass, plastic or the like. For purposes of this specification, the term "location" will refer either to an entrance door to an apartment, a residence such as a house, a commercial facility, or other premises.

For purposes of this specification, the term "mail" is intended not only to items, such as letters, magazines or the like that are delivered by the Postal Service, but intended to encompass newspapers, advertisements, flyers, correspondence, invitations, gifts, packages and the like, that may be sent to or left at a person's residence or place of business, or delivered by various courier services.

The shelf 110 can be a piece of a material capable of supporting the anticipated load, such that a shelf made from metal or plastic is acceptable. In the embodiment shown, shelf 110 is made from plywood and molding. The top side 112 of the shelf terminates in a plurality of ridges 114 towards the outer edge of the tray. In the embodiment shown, for example, the ridges are ½ inch round wood molding. The shelf 110 is attached to the door 10 by a hinge 118 which is attached to the bottom side 120 (FIG. 2) of the shelf 110 using a fastener 122. In the embodiment shown, the hinge 118 is a conventional hinge as known to those skilled in the art, and generally includes a pair of members attached to each other with an attachment component surrounding a central pin, and each member has an opening for insertion of a fastener therethrough. In the embodiment shown, fastener 122 is a screw that is appropriate for the combination of the door 10 and the shelf 110, such that the fastener can be a wood screw, self-tapping screw or the like. Alternatively, the fastener 122 could be a nail, or an adhesive, or fastener such as a hook and loop material, or other types of fasteners or attachment means known to those skilled in the art.

Figure 2:
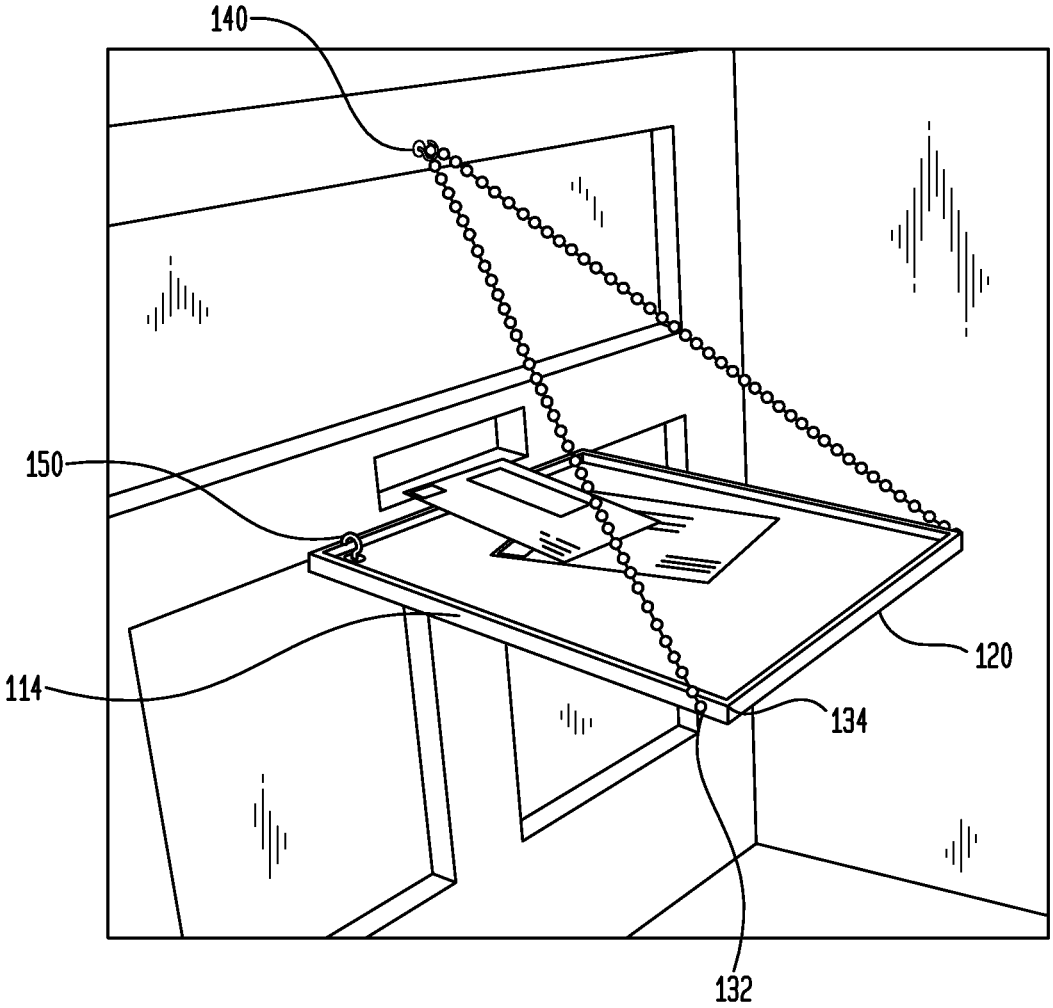
FIG. 2 shows the embodiment of FIG. 1 in its operative position.
Figure 2A:
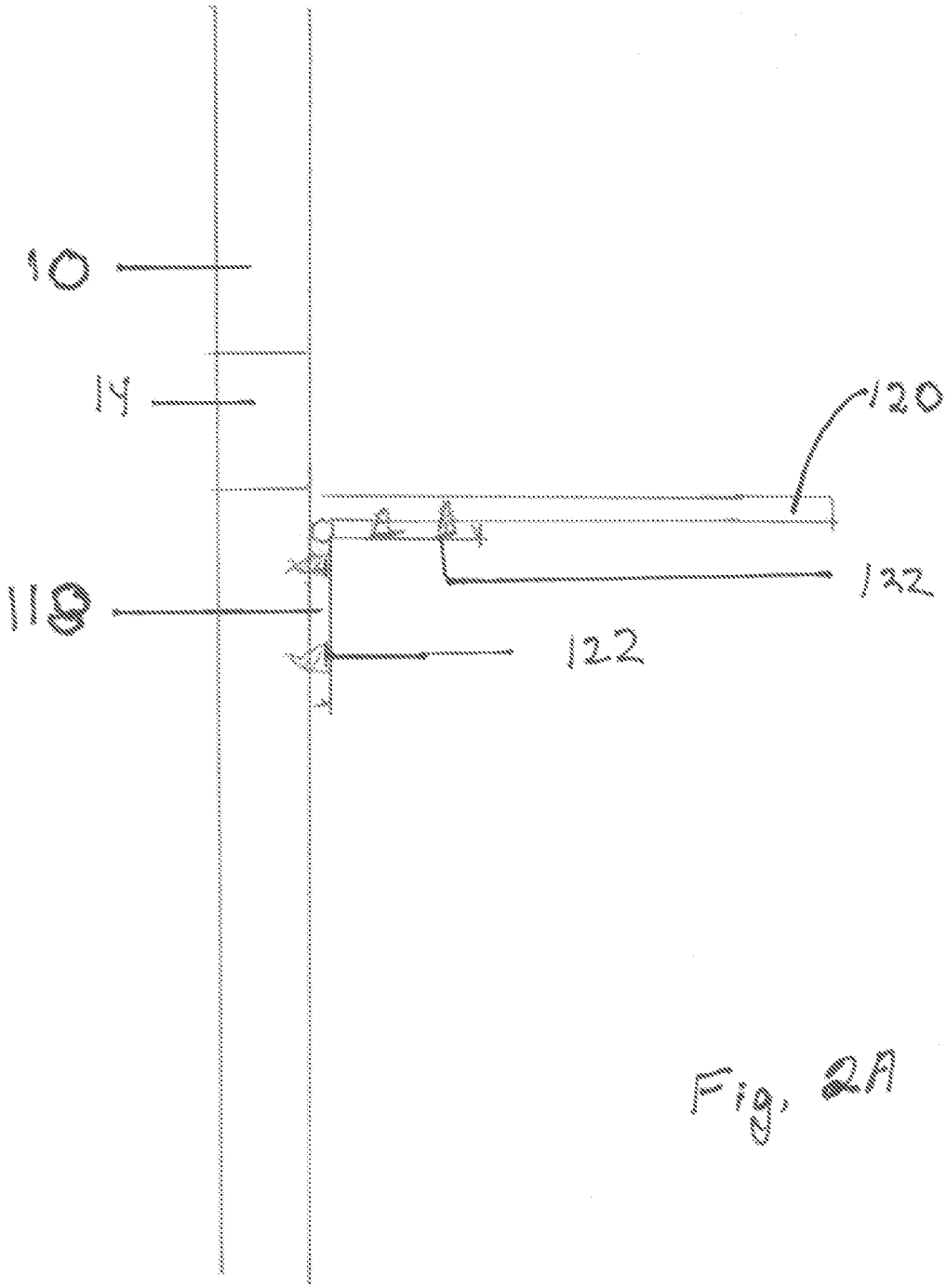
FIG. 2A is a side sectional view of the embodiment of FIG. 2, showing the attachment of the shelf bottom to the door.

Referring to FIGS. 1-2, the shelf 110 is moved from its folded, or storage, position (FIG. 1) to its operative position (FIG. 2) by means of a chain 130 that is attached to door 10 by a fastener 140. Chain 130 is attached to the shelf 110 by one or more fasteners 132 attached to the shelf proximate the corners 134 distal from the door 110. In the embodiment shown the chain 130 is attached to a side of the shelf 110. In other embodiments the chain 130 could be attached to the shelf 110 at other locations, such as to the top of the shelf 112, to the bottom of the shelf 120, to the distal most end of the shelf 134, or combinations thereof. The chain 130 functions to keep the shelf 110 in a proper position to receive incoming mail. Generally, the length of the chain 130 should be at least equal to the length of the shelf 112. In other embodiments the length of the chain 130 can be greater than the length of the shelf 112.

In the embodiment shown, fastener 132 is wood screw. The chain 120 attaches to the door 10 by means of a cup screw hook which is positioned on the door 10 and the chain 120 is slid over the cup screw hook to support the shelf and keep it in a proper position to receive incoming mail. Other types of fasteners 132, such as a nail or screw or other types of fasteners known to those skilled in the art, could also be utilized instead of the cup screw hook.

In the embodiment shown, fastener 140 is a cup screw hook, readily available from hardware stores, and known to those skilled in the art, such that the chain 130 is slid over the cup screw hook and is retained within fastener 140. Other types of fasteners 140 known to those skilled in the art, could also be utilized instead of the cup screw hook, for example, a nail, screw, J-hooks, S-hooks or a carabiner.

In the embodiment shown, a chain is used to adjust the position of the shelf. However, other equivalent materials could be used for adjusting the position of the shelf, and this includes one or more members from the group consisting of a chain, a rope, wire, leather, an elastic band, various fabrics, yarn, cord, twine, string, lanyard and others known to those skilled in the art.

For purposes of this specification, the term "generally perpendicular" is intended to have its usual meaning, referring to an angle of approximately 90 ninety degrees. It is, however, to be understood that a certain degree of deviation from this angle is acceptable for both the shelf and mounting mechanisms, the main concern being that the items can still be retained on the shelf when embodiments of the present invention are in their operative position.

FIG. 1 illustrates this embodiment of the present invention in the folded position. In order to utilize this embodiment, the chain is removed from its storage hook 150 on shelf 110, and while lifting the shelf 110 the user moves the chain to fastener 140 where the chain 130 engages the hook of the fastener 140. The user then adjusts the position of the shelf 110 so that the shelf 110 is beneath the mail slot 14 and that items deposited through the mail slot 14 should be able to move along the shelf surface. The door can be opened and closed with the shelf 110 in its operative position (FIG. 2). After mail has been delivered, the mail is removed from the shelf 110, the chain removed from fastener 140, the shelf allowed to return to its folded position, ands the chain placed back on the storage hook 150.

An alternate embodiment (not illustrated) can employ a support, such as a board or pipe or other support member, that is placed under the shelf, between the shelf and the floor.

An alternate embodiment of the present invention is shown as reference numeral 300 (FIGS. 3-7), comprising a bracket 310, a frame 340 and a tray 370. The bracket 310 attaches to the door 10 proximate to and beneath the mail slot 14, and receives both the frame 340 and the tray 370.

In this embodiment, the bracket 310 comprises a base 312, and a pair of arms 314, 316 extending from the base 312. In an embodiment, the arms 314, 316 are generally perpendicular to the base 312. The base 312 includes one or more openings 318 through which is inserted a fastener 132 (not shown) to mount the bracket 310 to the support (door 10) beneath the mail slot 14.

Figure 4:
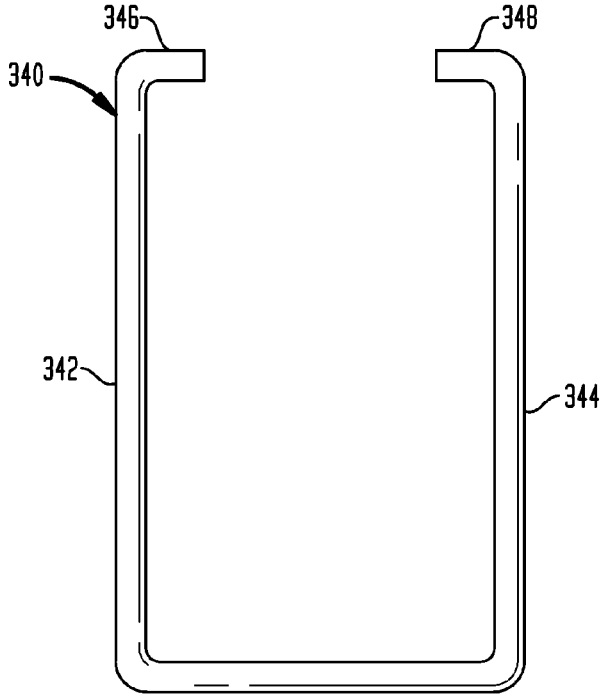
FIG. 4 illustrates a frame for the embodiment shown in FIG. 3.
Figure 5:
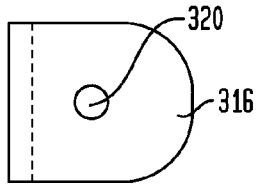
FIG. 5 is a detailed view of the door bracket shown in FIG. 4.
Figure 6:
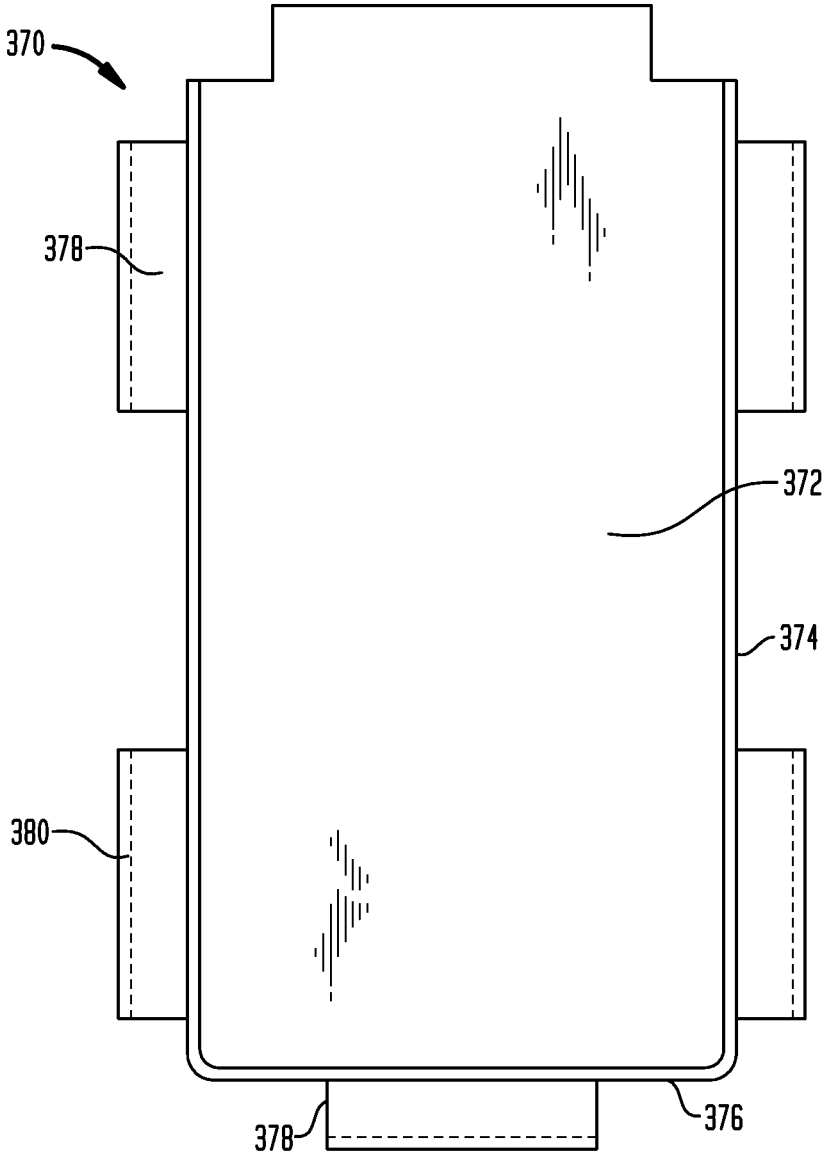
FIG. 6 is an top plan view of the tray for the embodiment shown in FIG. 3.

Each arm contains an opening 320 which will receive an end member of frame 340. The frame 340 is shaped as shown in FIG. 4, and can be described as a rectangle with a portion of one of the short sides missing. The frame arms 342 and 344 each terminate in an end 346 and 348, each end being at approximately a right angle to the frame arms 342 and 344, such that when the frame 340 is inserted into the bracket 310, the ends 346 and 348 are pointing in a direction generally parallel with the plane of the bracket 310. The frame 340 can be described as resembling an extended C, that is, with the upper and lower arms of the C being drawn out with respect to the vertical line of the letter.

The tray 370 comprises a tray body 372 having a plurality of tabs 378 on tray body's 372 sides 374 and ends 376. Each tab 378 terminates in a grip member 380 such that when the tray 370 is placed onto the frame 340, each tab 378 is folded down and the grip member 380 then folded around the frame 340 to form a snug fit thereon. When attaching the frame 370 to frame 340, it is easiest if the tab that will be located nearest the door 10 is attached and secured to the frame first, but this is not a required first step. In the embodiment shown in FIGS. 3-6, the tray can be manufactured from a plastic, although alternate materials suitable for acting as a shelf can be substituted therefor. In this embodiment, the tray ends differ in depth, the end proximate the door 10 having a depth that is shallower than the depth of the end distal from the door. Alternate embodiments (such as shown in FIG. 1) could employ a shelf that is flatter, or whose depth varies from that shown in the embodiment of FIG. 7. The door 10 is functional even with embodiment 300 in the operative position.

Figure 7:
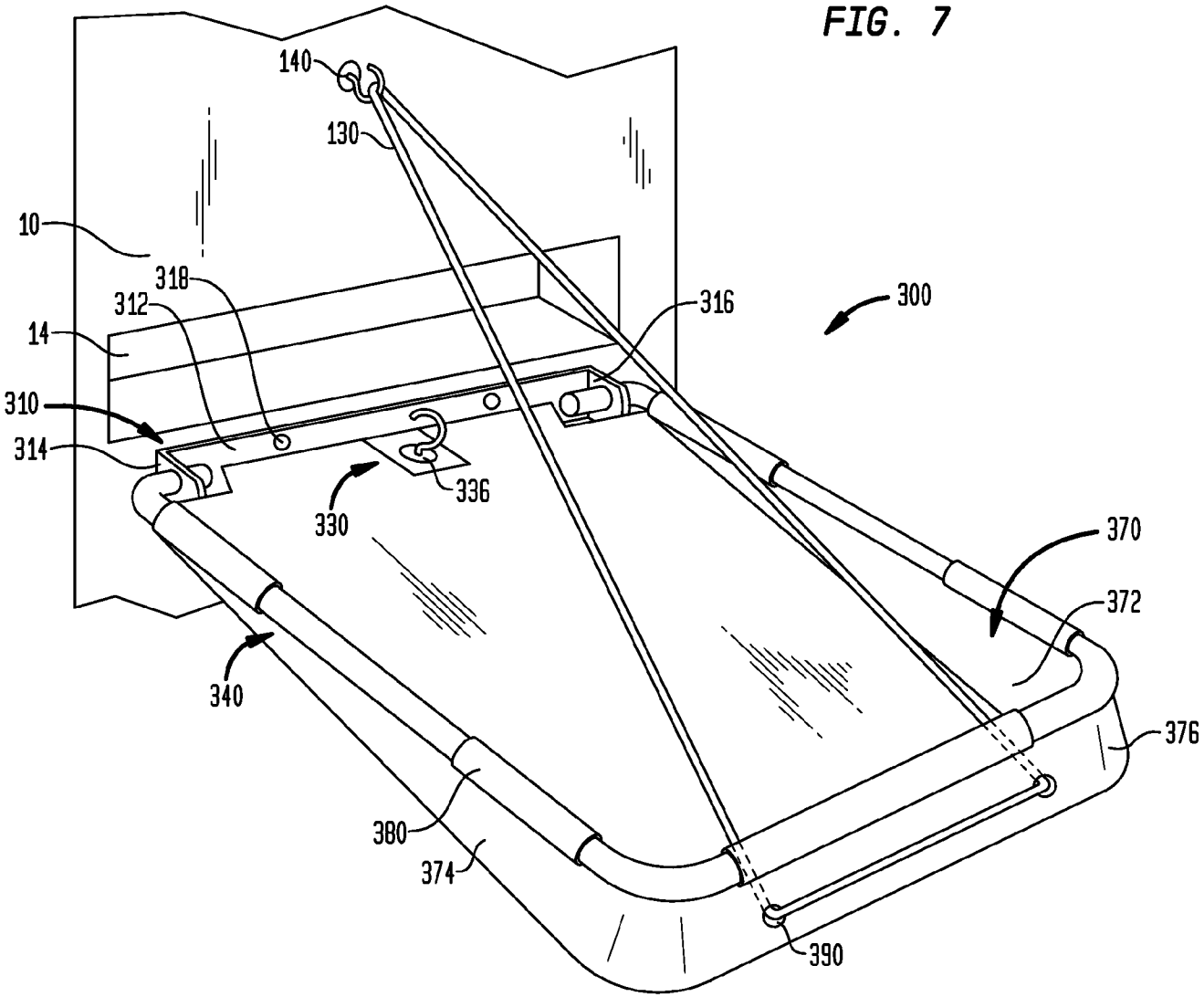
FIG. 7 illustrates the embodiment of FIGS. 3-5 in its operative position.
Figure 8:
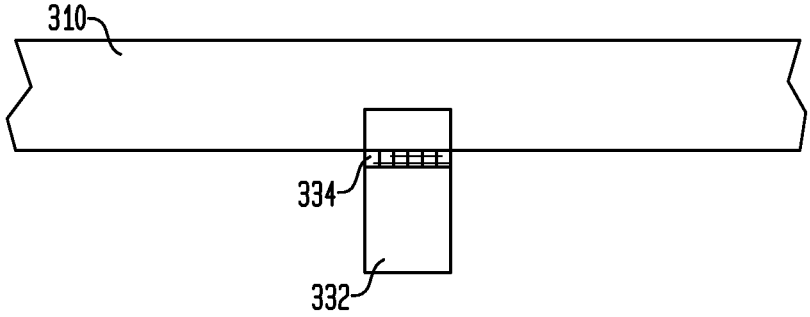
FIG. 8 is a rear view of the bracket and hinge of the embodiment shown in FIG. 7.

FIG. 7 illustrates an alternate embodiment of the storage hook, reference numeral 330, that has a base 332 that is pivotably attached to bracket 310. The base 332 has a hinge 334 (FIG. 8) that is attached to bracket 310, either by fasteners (not shown) or by other known methods of joining components, such as by welding or by an adhesive. A hook 336 is secured within base 332. In another embodiment, the storage hook 330 can be attached to the tray body 372, with the base 332 either being formed as an integral part of tray 372, or attached thereto by means of a fastener, adhesive, or other method of attachment known to those skilled in the art. Other types of fasteners 336, such as a nail, screw or other types of hooks or fasteners known to those skilled in the art, could also be utilized instead of the cup screw hook.

This embodiment 300 is mounted by first attaching the frame 310 to the door 10 by inserting a fastener 132, such as a screw, through the bracket 310 and securing the bracket 310 to the door 10. One end of the frame 340 is positioned into the opening 320 on one side of the bracket 310, and then the other end of the frame 340 is positioned into the opening 320 on the other side of the bracket 310; the frame 340 may require some flexing in order to position it properly. The tray 370 is then placed into position atop the frame 340 as described in preceding paragraphs and the shelf is ready for use. Prior to the assembly of the tray 370 to frame 340 two holes 390 are drilled at the deep end wall 376 (FIG. 6), the holes having a size sufficient to accommodate the chain 130 that will support the shelf when in the operating position (FIG. 7).

Figure 3:
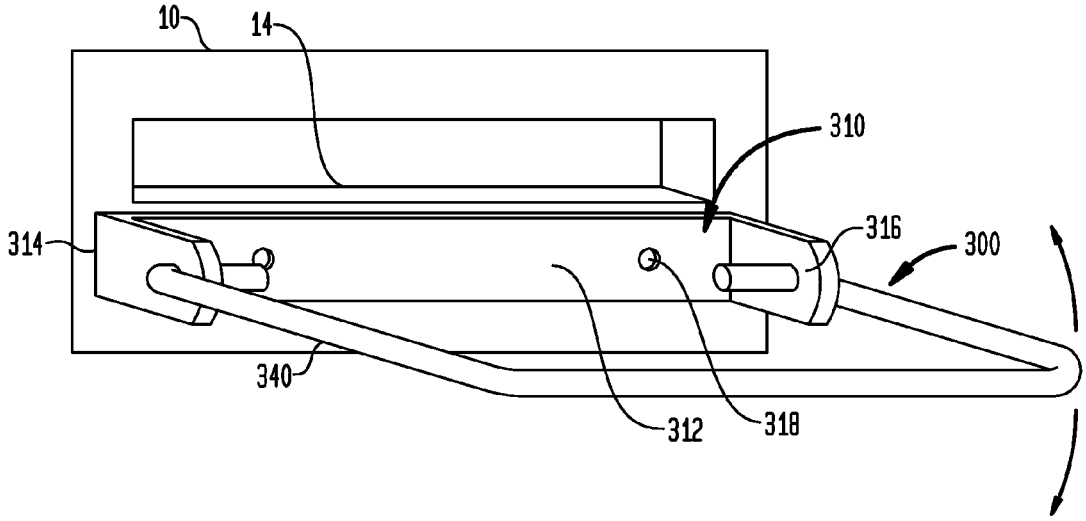
FIG. 3 illustrates an alternate embodiment of the present invention. The arrows at the right indicate directional movements for the frame.

In embodiments, the bracket 310 can be manufactured from any suitable material, ranging from wood, plastic, nylon, metals such as steel, brass, copper, stainless steel or the like. Polished brass is one suitable material, but other materials may be chosen, such as brushed brass, chrome, stainless steel or the like, to provide a particular finish for decorative purposes. In the embodiment of FIG. 3, the bracket is made from a 0.20 inch thick by 1 inch wide strip of brass, with the length being sufficient to fit beneath the mail slot. However, other thicknesses or widths may be employed, and the bracket should be strong enough to support the frame, the attached shelf and the weight of the materials it is intended to support.

Although this invention has been described with a certain degree of particularity, it is to be understood that the present disclosure has been made only by the way of illustration, and that numerous changes in construction and arrangement of parts may be resorted to without departing from the spirit and scope of the invention.

The invention claimed is:

1. A shelf assembly comprising:

a shelf, the shelf having a body, a first end and a second end, the second end having a depth that is greater than the depth of the first end, the second end further comprising an opening therethrough, the ends being connected by sides;

a means for positioning, the means for positioning received through the second end opening, the means for positioning having a length that is at least equal to the length of the shelf;

a receptacle for the shelf, the receptacle comprising a bracket and a frame, the bracket comprising a base, the base terminating in a pair of ends, each end having an opening therethrough, the openings being sized to receive the frame therethrough, and the base further comprising one or more apertures therethrough, the apertures sized to receive a fastener therein;

the frame comprising an extended C-shaped member having a shape to receive the shape of the tray shelf therein, the frame terminating in a pair of ends, the frame ends sized to be received within the base opening; and a storage hook, the storage hook positioned to receive the means for positioning when the shelf is in a storage position.

2. The shelf as described in claim 1, wherein the storage hook is pivotably attached to the bracket, and the storage hook depends towards the shelf body.

3. The shelf as described in claim 1, wherein the storage hook is attached to the shelf first end proximate the bracket.

4. The shelf as described in claim 1, further comprising a second storage hook, the second storage hook for attachment to a surface to which the bracket will be attached, whereby movement of the means for positioning from the shelf to the second storage hook effects movement of the shelf from a storage position to an operative position when the bracket is attached to the surface.

5. A shelf assembly comprising:

a shelf, the shelf having a body, a first end and a second end, the second end having a depth that is greater than the depth of the first end, the second end further comprising an opening therethrough, the ends being connected by sides;

a plurality of tabs extending from the body, each tab further comprising a grip member;

a means for positioning, the means for positioning received through the second end opening, the means for positioning having a length that is at least equal to the length of the shelf;

a receptacle for the shelf, the receptacle comprising a bracket and a frame, the bracket comprising a base, the base terminating in a pair of ends, each end having an opening therethrough, the openings being sized to receive the frame therethrough, and the base further comprising one or more apertures therethrough, the apertures sized to receive a fastener therein;

the frame comprising an extended C-shaped member having a shape to receive the shape of the shelf therein, the frame terminating in a pair of ends, the frame ends sized to be received within the base opening; and a storage hook, the storage hook for receiving the means for positioning when the shelf is in a storage position.

6. The shelf as described in claim 5, wherein the shelf tabs engage the frame, and secure the frame therein.

7. The shelf as described in claim 6, wherein the grip members are exposed upon engagement of the tabs to the frame.

8. The shelf as described in claim 5, further comprising a second storage hook, the second storage hook for attachment to a surface which receives the bracket, whereby movement of the means for positioning to the second storage hook effects movement of the shelf from a storage position to an operative position when the bracket is attached to the surface.

9. The shelf as described in claim 5, wherein the storage hook is attached to the bracket.

10. The shelf as described in claim 9, wherein the storage hook further comprises a base that is pivotably attached to the bracket.

11. The shelf as described in claim 5, wherein the storage hook is attached to the shelf first end.

12. The shelf as described in claim 5, wherein the storage hook comprises a fastener chosen from the group comprising a hook, a nail, a screw, a prong, an eyelet, a cup hook and a J-hook.

* * * * *